US009433944B2

(12) United States Patent
Blumentritt et al.

(10) Patent No.: US 9,433,944 B2
(45) Date of Patent: Sep. 6, 2016

(54) DEVICE FOR PROVIDING PIPETTE TIPS

(71) Applicant: Eppendorf AG, Hamburg (DE)

(72) Inventors: Michael Blumentritt, Hamburg (DE); Frank Horstmann, Lensahn (DE); Juergen Boeckmann, Tangstedt (DE)

(73) Assignee: EPPENDORF AG, Hamburg (DE)

( * ) Notice: Subject to any disclaimer, the term of this patent is extended or adjusted under 35 U.S.C. 154(b) by 0 days.

(21) Appl. No.: 14/250,530

(22) Filed: Apr. 11, 2014

(65) Prior Publication Data

US 2014/0308181 A1 Oct. 16, 2014

(30) Foreign Application Priority Data

Apr. 12, 2013 (EP) ..... 13001900

(51) Int. Cl.
*B01L 9/00* (2006.01)
*B01L 3/02* (2006.01)

(52) U.S. Cl.
CPC ..... *B01L 9/543* (2013.01); *B01L 3/0275* (2013.01); *B01L 2200/025* (2013.01); *B01L 2200/087* (2013.01); *B01L 2300/02* (2013.01); *B01L 2300/043* (2013.01); *B01L 2300/0829* (2013.01); *B01L 2300/0858* (2013.01)

(58) Field of Classification Search
CPC ..... B65D 25/108
USPC ..... 422/511, 526, 560, 564
See application file for complete search history.

(56) References Cited

U.S. PATENT DOCUMENTS

| | | | | |
|---|---|---|---|---|
| 5,913,689 | A * | 6/1999 | Kato | 439/76.2 |
| 6,019,225 | A * | 2/2000 | Kalmakis et al. | 206/563 |
| 6,062,388 | A * | 5/2000 | Ohayon | 206/509 |
| 6,098,819 | A * | 8/2000 | Link | 211/85.13 |
| 6,534,015 | B1 | 3/2003 | Viot et al. | |
| 2005/0150808 | A1 * | 7/2005 | Sarna et al. | 206/562 |
| 2010/0012546 | A1 * | 1/2010 | Togashi et al. | 206/534.1 |
| 2010/0143197 | A1 * | 6/2010 | Link et al. | 422/104 |
| 2011/0236278 | A1 * | 9/2011 | Motadel et al. | 422/560 |
| 2012/0328489 | A1 * | 12/2012 | Beese et al. | 422/526 |

FOREIGN PATENT DOCUMENTS

| | | |
|---|---|---|
| EP | 2 333 559 A1 | 6/2011 |
| EP | 2 535 109 A2 | 12/2012 |

* cited by examiner

*Primary Examiner* — Jill Warden
*Assistant Examiner* — Matthew Krcha
(74) *Attorney, Agent, or Firm* — Vidas, Arrett & Steinkraus, P.A.

(57) ABSTRACT

A device for providing pipette tips includes a plate-shaped carrier with a base surface, holes in the carrier perpendicular to the base surface, at least one vertically running cut-out in the outer sides of two opposing narrow sides of the carrier to accommodate two vertical guide ribs at a distance from each other, pipette tips in the holes, a bottom part with sidewalls that extend upwards from a standing surface, said sidewalls surrounding a rectangular seat for the carrier with the inserted pipette tips, wherein two opposing first sidewalls project further upward from the standing surface than to opposing second sidewalls, a supporting mechanism on the inner sides of at least two opposing sidewalls to support the carrier in a horizontal alignment at the bottom edges of narrow sides, and two vertical guide ribs engaging in the at least one cut-out when the carrier is placed on the supporting mechanism.

17 Claims, 9 Drawing Sheets

37
17
9
7
20
2
19
1
35
8
55
16
28
3
13
36
12
11
4
27
20
21
14
8
15
18
34
38
39

1
2
4
34
38
27
20
33
40
28
53

20
35
38
11,13
36
40
33
3
2
1
20
7
24

22
51
45,46
47
48
20
42
43,46
51
22
50
44
50
43
40
44
43
37
36

54
24
47
VI
20
50
47
27
35
V
V
9
37
7
36
37
2
36
4
8
1
44
53
28
47
20
VI
50
42
27
34

DEVICE FOR PROVIDING PIPETTE TIPS

CROSS-REFERENCE TO RELATED APPLICATIONS

This Utility Patent Application claims priority to EP 13 001 900.3, filed on Apr. 12, 2013.

STATEMENT REGARDING FEDERALLY SPONSORED RESEARCH

Not applicable.

BACKGROUND OF THE INVENTION

The invention relates to a device for providing pipette tips.

Pipettes tips are small tubes made of plastic which are used in the laboratory for metering liquid samples, preferably within the range of 0.1 μL to 100 mL. They have a bottom opening for liquid and a top opening for air, and the cross-section of the pipette tips generally increases from the bottom opening toward the top opening.

To meter liquid, the top end of the pipette tip is connected to a pipette such that the top opening is joined to a pipette displacement device for air. The pipette tip with the opening is clamped onto a shoulder of the pipette, or clamped in a hole of the pipette. A channel terminates in the face of the shoulder or respectively in the base of the hole, and the channel is connected to the pipette displacement device. The displacement device of a piston stroke pipette is a cylinder with a piston which can move therein. With the assistance of the displacement device, an air volume is shifted such that a specific amount of liquid is drawn into the pipette tip and discharged therefrom. The metered amount of liquid depends on the displacement of the displacement device. Fixed volume pipettes with a constant metering volume have a constant displacement, and variable pipettes with an adjustable metering volume have an adjustable displacement. With direct displacement pipettes, a piston is integrated in the pipette tip which is driven by the displacement device.

After being used, the pipette tip is removed from its seat on the pipette, for which purpose the pipette can have an ejector that, upon being actuated, pushes the pipette tip off of its seat. Then the pipette can accommodate a new pipette tip. This prevents the carryover of sample liquid between sequential metering.

In order to affix pipette tips on the seat of a pipette, pipette tips are provided on devices for providing pipette tips. These devices have a plate-shaped carrier with a substantially rectangular surface made of plastic, also termed a tray or wafer, with a plurality of holes in a matrix arrangement. The perforated plate generally has 96 holes in 8 rows and 12 columns. Pipette tips are inserted from above into the holes, and they do not fall through the holes due to a diameter that is wider at the top or a collar at their top end.

Furthermore, these devices comprise a bottom part which is designed as a box that is closed at the bottom and open at the top, and a rectangular frame (also termed a "rack") that is open at the bottom or the top. A carrier equipped with pipette tips is placeable on the top edge of the bottom part on means for supporting such that the pipette tips and the carrier extend into a seat in the bottom part. Known devices for providing pipette tips have a gripping tab on each of two opposing narrow sides of the carrier, the tabs being connected to the bottom edge of the narrow side of the carrier, having an actuating end at the top, and possessing a locking bead therebetween that locks with a locking projection on the inside of a side wall of the bottom part. The narrow sides are the two longitudinal sides and the two short sides of the rectangular carrier.

The pipette tips can be removed from a device for providing pipette tips by pressing the seat of a single channel pipette, or the seats of a multi-channel pipette, onto or into the top ends of the pipette tips, individually or several at the same time. The locked gripping tabs prevent the carrier from being unintentionally lifted while the pipette tips are being removed by a pipette.

Devices for providing pipette tips are known in which the bottom part can be reused after all of the pipette tips have been removed. To exchange the carrier, the lock can be released by pressing the gripping tabs toward each other and lifting the gripping tabs. The bottom part can be equipped with fresh pipette tips by means of refill packs. The refill packs comprise one or several plate-shaped carriers that are equipped with pipette tips. Refill packs are known, for example, with one or several carriers equipped with pipette tips arranged in folding boxes or cardboard frames, or in simple plastic boxes or plastic frames.

In order to equip the bottom part with a carrier with pipette tips from a refill pack, the user must precisely align the new carrier with the top opening of the bottom part and lower the new carrier with the pipette tips into the seat until the gripping tabs lock in the bottom part. It is difficult to correctly align the carrier equipped with pipette tips with the bottom part and find the locking position. Catching can occur which disturbs the process and prevents the finding of the locking position. If the carrier does not lock with the bottom part, the carrier can be lifted while seating pipette tips, and the pipette tips can consequently fall out. A further disadvantage is that the user cannot read product information affixed to one or more narrow sides of the carrier when the carrier is locked with the bottom part since the side walls of the bottom part cover the narrow sides. In order to read the product information, the user must release the lock and lift the carrier. If the product information is for example arranged on a label on the outside of the bottom part, there is no guarantee that it relates to the refilled pipette tips since it is possible that pipette tips of a different kind have been refilled.

BRIEF SUMMARY OF THE INVENTION

Against this background, an objective of the invention is to create a device for providing pipette tips that makes it easier to insert a carrier with pipette tips and read product information on the narrow sides of the carrier.

The device according to the invention for providing pipette tips may include:

- a plate-shaped carrier with a substantially rectangular base surface,
- a plurality of holes in the carrier aligned perpendicular to the base surface,
- at least one vertically running cut-out in the outer sides of two opposing narrow sides of the carrier that are dimensioned to each at least partially accommodate two vertical guide ribs at a distance from each other, each having a rib width of 2.5 mm to 4 mm and a rib height of 2.5 mm to 4 mm,
- pipette tips inserted in the holes,
- a bottom part with sidewalls that extend upwards from a standing surface, said sidewalls surrounding a rectangular seat for the carrier with the inserted pipette tips, wherein two opposing first sidewalls project further upward from the standing surface than to opposing second sidewalls, supporting means at the inner sides of at least two opposing sidewalls that are constituted such that they support the carrier in a horizontal alignment at its bottom edges below the top edges of all sidewalls, and two vertical guide ribs at a distance from each other, each having a rib width of 2.5 mm to 4 mm and a rib height of 2.5 mm to 4 mm on the inner side of each first sidewall, wherein the two guide ribs engage in the at least one cut-out in a narrow side of the carrier when the carrier is placed on the supporting means.

The device according to the invention has at least one vertically running cut-out in each of the outer sides of two opposing narrow sides of the plate-shaped carrier. The cut-out is a vertically running recess in a narrow side of the carrier. The narrow sides of the plate-shaped carrier are the sides of the carrier that connect the large-surfaced top and bottom side of the carrier to each other at the edge. The plate-shaped carrier preferably has a rectangle shape, and the narrow sides are two longitudinal sides and two transverse sides of the carrier. Furthermore, the device has a bottom part that has two opposing first sidewalls which project further upward from a standing surface than two opposing second sidewalls. There are means for supporting the carrier in a horizontal alignment on the inner sides of the least two opposing side walls. Furthermore, the two first sidewalls each have two vertical guide ribs at a distance from each other. The cut-outs of the carrier and the guide ribs of the bottom part are tailored in relation to each other such that the guide ribs engage at least partially in the cut-outs when the carrier is placed on the supporting means. In this position, the carrier is enclosed at the perimeter by the side walls of the bottom part because the carrier sits on the supporting means below the top edges of all side walls. The carrier with its cut-outs must be correctly aligned on the guide ribs to be placed on the supporting means. When the carrier with the cut-outs is not correctly aligned on the guide ribs, the guide ribs prevent the carrier from descending to the supporting means. The top ends of the guide ribs are bearing points on which the carrier can be displaced in the horizontal direction parallel to the first sidewalls until the guide ribs are correctly aligned with the recesses and enter therein. Since the carrier is supported by two guide ribs on each of the two first sidewalls, tilt-free horizontal mounting of the carrier is feasible when it is not precisely aligned with the seat of the bottom part. The carrier can be placed on the top ends of the guide ribs with the bottom edges in horizontal alignment that neighbour the cut-outs. This mounting of the carrier can be supported by seating the carrier on a top edge of a second sidewall of the bottom part when the top edge of the second sidewall is arranged at the same height as the top ends of the guide ribs. The rib width of 2.5 mm to 4 mm and the rib height of 2.5 mm to 4 mm ensure that the carrier slides effectively on the top ends of the guide ribs. The ribs do not provide any major friction resistance to the horizontal displacement of the carrier and do not catch on the bottom edge of the carrier. In addition, the dimensions of the guide ribs ensure that they can be produced by means of injection moulding with a slight amount of material and will not break under a load from placing the carrier on top of them. In addition, the rib height is good for carriers with dimensions that are significantly less in the direction parallel to the second sidewalls than the space between the inner sides of the first sidewalls which makes it additionally easier to insert the carrier into the seat. The rib width identifies the dimension of the guide rib in a horizontal direction parallel to the first sidewalls, and the rib height identifies the dimension of the guide rib in a horizontal direction perpendicular to the first sidewalls. Because their height is less than the first sidewalls, the second sidewalls enable the carrier to be horizontally displaced on the guide ribs and with its edge areas above the second sidewalls until the pipette tips come into contact with the inner sides of the second sidewalls. This makes it easier to introduce the carrier equipped with the pipette tips into the seat. Then the carrier can be aligned with the cut-outs on the guide ribs by shifting horizontally. Because the second side walls do not project upward from the standing surface as high as the first sidewalls, the user can read product information on the longitudinal sides of the carrier parallel to the second sidewalls even when the carrier is inserted into the seat of the bottom part. The product information can for example identify the filling volume and/or the type of pipette tip. The invention therefore makes it easier to insert the carrier equipped with the pipette tips into the bottom part. Furthermore, two opposing longitudinal sides of the carrier can be used as carriers for product information which is even legible when the carrier is inserted in the bottom part.

The bottom part is preferably a box which is closed at the bottom by a floor wall from which the sidewalls extend upward. The standing surface can be formed by the bottom side of the floor wall or by the bottom side of feet that project downward with reference to the floor wall. Alternately, the bottom part is a frame formed by the side walls. The standing surface can be formed by the bottom edges of the side walls or the bottom side of feet that project downward from the sidewalls.

According to one embodiment, each guide rib is formed from a group with at least two parallel rib elements, and each rib element has a width of 0.50 mm to 1.5 mm, and the distance between the rib elements of a group is 0.5 mm to 1.5 mm. This makes it easier to produce guide ribs that offer slight resistance to the horizontal displacement of the carrier by means of injection moulding using little material.

According to another embodiment, the dimensions of the carrier in the direction parallel to the second side walls at the bottom edge of the carrier are less than the distance between the inner sides of the first sidewalls at the top edge of the first sidewalls by 4 mm to 7 mm. Given the gap between the top edges of the first side walls and the bottom edge of the carrier, the carrier can be more easily inserted into the seat of the bottom part.

According to another embodiment, the cut-outs in at least one narrow side of the carrier are two vertical grooves at a distance from each other with a groove width of 2.5 mm to 4.5 mm each. The carrier is only slightly weakened by the two grooves at a distance from each other in the area of the narrow sides, and the carrier therefore possesses a high stability. According to an alternative embodiment, at least one narrow side of the carrier has a single cut-out in the form of a vertical groove that accommodates both guide ribs.

According to one embodiment, the outer edge of at least one cut-out in at least one narrow side of the carrier is bordered by an outwardly projecting skirting that runs along the bottom edge of the carrier. The skirting can be used to mount a protective cover which projects laterally beyond the carrier. The carrier with the mounted protective cover can be inserted in a bottom part, wherein the protective cover protects the pipette tips from becoming soiled.

According to another embodiment, the at least one cut-out is formed in at least one narrow side of the carrier only in the outwardly projecting skirting. According to another embodiment, the base of the cut-out is flush with the outer side of the top section of the narrow side of the carrier which is arranged above the skirting. According to another embodiment, the base of the cut-out projects outward with reference to the outer side of the top section of the narrow side. According to another embodiment, the at least one cut-out is formed in at least one narrow side of the carrier both in the skirting as well as in the top section of the narrow side.

According to one embodiment, the inner edge of the at least one cut-out in at least one narrow side is bordered by a gripping tab which is connected at the bottom to the bottom edge of the narrow side of the carrier and extends upward beyond the first sidewalls at a distance from the narrow side. The gripping tab makes it easier to insert and remove the carrier into and out of the bottom part. In addition, the carrier can abut the inner sides of first sidewalls by means of the gripping tab in order to hold the carrier in a specific position in the bottom part.

Preferably, two vertical grooves at a distance from each other in at least one narrow side are bordered by outwardly projecting skirting on their outer edge, and by a gripping tab on their inner edge. The invention includes alternative embodiments in which two vertical cut-outs at a distance from each other in at least one narrow side are bordered by the gripping tab on their inner edges and extend outward up to the neighbouring longitudinal sides of the carrier.

According to another embodiment, at least one gripping tab has a first locking means on its outer side that locks with a second locking means on the inner side of the first sidewall. In this embodiment, the carrier is releasably connectable to the bottom part in order to prevent the carrier from being unintentionally pulled out while removing pipette tips. For exchanging, the carrier can be unlocked by actuating the gripping tabs.

According to one embodiment, the carrier has a horizontal cover wall with holes arranged therein, and a peripheral apron projecting downward from the side edges of the cover wall. The embodiment can be produced in a stable manner that saves material by injection moulding.

According to another embodiment, the apron has an outwardly projecting bottom section forming the skirting outside of the cut-outs. This embodiment can be produced in a stable manner that saves material by injection moulding.

According to another embodiment, the edges of the holes are connected to sleeves that project from the bottom side of the cover wall and into which the pipette tips are inserted. By means of this stable embodiment that can be produced in a material-saving manner by injection moulding, pipette tips are better aligned which makes it easier to align the carrier on the seat of the bottom part.

According to one embodiment, the gripping tabs are strip-shaped and have first means for locking in the form of at least one outwardly protecting horizontal bead. This further promotes the material-saving production of the carrier by means of injection moulding.

According to one embodiment, the means for supporting comprise vertical ribs projecting from the inner sides of the side walls. This also promotes a stable design of the bottom part which can be produced in a material-saving manner by means of injection moulding. Preferably, the first and second sidewalls each have a plurality of supporting means. The ribs have a rib width of preferably 0.5 mm to 1.5 mm, and especially 1.0 mm.

According to another embodiment, the supporting means have projections that project at least partially from their inner edges with outwardly angled bevels on the outer sides that grip behind the inside of the carrier apron. Due to the bevels, the carrier apron can be pulled outward in order to move the carrier into a correct shape since the apron can tend to collapse inward somewhat, especially when designed with a thin wall.

According to another embodiment, a protective cover is placed on the top side of the carrier and covers the pipette tips inserted in the holes. The pipette tips are protected by the protective cover when transferring the carrier from a supply package into the bottom part.

According to another embodiment, the bottom part has a pivotably mounted cover that, when in closed position, covers the seat along with an inserted carrier and if applicable the protective cover mounted thereupon, and is pivotable into an open position in which the carrier with the pipette tips and if applicable the mounted protective cover are removable from the bottom part, and insertable therein, and the pipette tips are removable from the carrier.

According to another embodiment, the carrier and/or the bottom part and/or the protective cover and/or the cover is made of a plastic. The same plastic or different plastics can be used for the cited components. All of the components or individual components are preferably made by means of injection moulding.

BRIEF DESCRIPTION OF THE SEVERAL VIEWS OF THE DRAWINGS

The invention is explained in greater detail below based on the appended drawings of an exemplary embodiment. The drawings show.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

In the present application, the references "top" and "bottom" as well as "vertical" and "horizontal" refer to an arrangement of the device in which the plate-shaped carrier is aligned horizontally, the standing surface of the bottom part sits on a horizontal base, and the carrier is inserted from above into the bottom part.

In the following explanation of different carriers of the device according to the invention, components with the same designation are provided with the same reference numbers.

Figure 1:
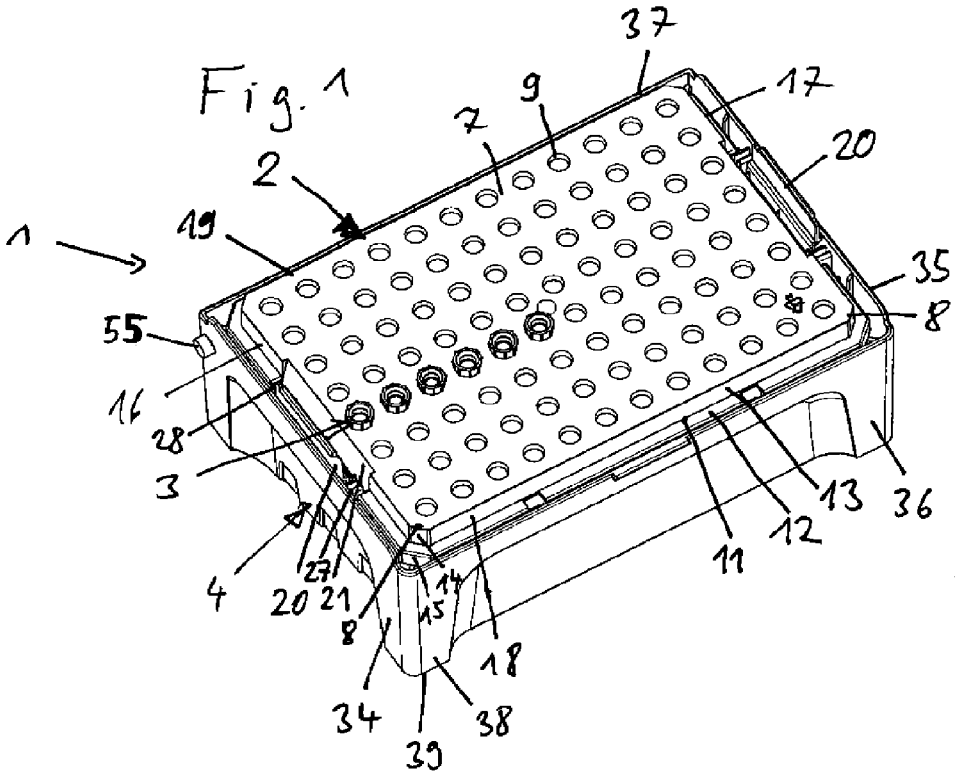
FIG. 1A device according to the invention in a perspective view diagonally from above and from the side.
Figure 4:
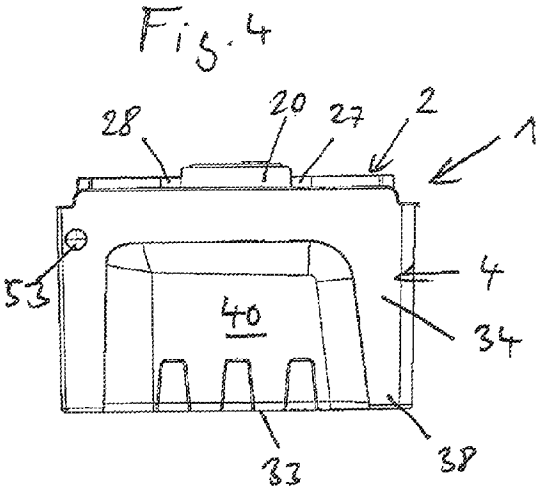
FIG. 4 the device in a view from the left side.
Figure 3:
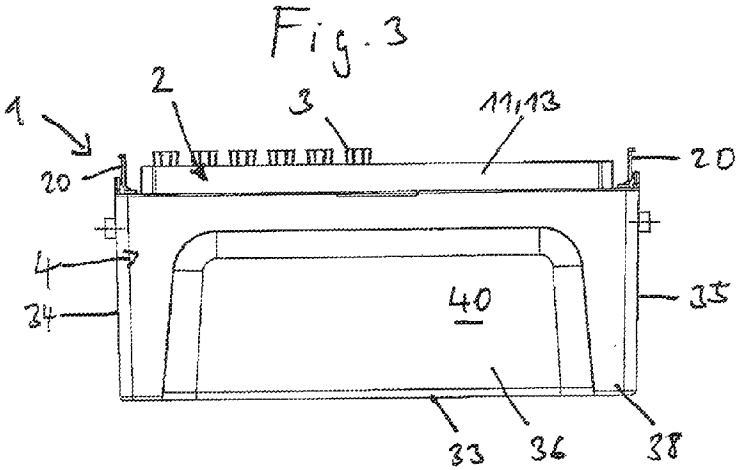
FIG. 3 the device in a front view.

According to FIG. 1, the device 1 according to the invention for providing pipette tips comprises a substantially plate-shaped and substantially rectangular carrier 2 that is equipped with pipette tips 3. Furthermore, the device 1 comprises a substantially box-shaped bottom part 4 in which the carrier 2 with the pipette tips 3 is inserted. In addition, the device 1 according to FIGS. 11 to 16 has a protective cover 5 that can be placed on the carrier, and a cover 6 that is pivotably connectable to the bottom part 4.

According to FIGS. 1 to 8, the carrier 2 has a substantially rectangular cover wall 7 that has chamfers 8 on the four corners. The cover wall 7 has a total of 96 circular holes 9 in eight rows and twelve columns that are aligned perpendicular to the cover wall 7. The holes 9 are dimensioned such that pipette tips 3 of a specific size and shape are insertable therein and, due to an expansion of their outer diameter at the top end, are held in the carrier 2 without falling through the holes 9. To accomplish this, the pipette tips 3 can have a diameter that expands continuously from the bottom end to the top end, or a sudden enlargement of the outer diameter.

Sleeves 10 extend vertically downward from the bottom side of the cover wall 7 and are connected at the top to the edges of the holes 9. Pipette tips 3 are inserted and guided in the sleeves 10. They project downward beyond the sleeves 10.

Furthermore, the carrier 2 has a peripheral apron 11 that projects upward approximately vertically and is connected at the top to the side edges of the cover wall 7. At the bottom, the apron 11 has an outwardly projecting bottom section forming a skirting 12.

At its top section 13 and in the area of the skirting 12, the apron is also provided with chamfers 14, 15 on the edges.

The base surface of the carrier 2 substantially corresponds to the base surface of a microtiter plate, and the arrangement of the holes 9 substantially corresponds to the arrangement of the wells in a microtiter plate with 96 wells according to the ANSI standard and the recommendation of the Society for Biomolecular Screening (SBS). Consequently, a group of pipette tips 3 that are accommodated by the carrier 2 by means of a multichannel pipette adapted to this standard can be directly aligned with a group of wells in a microtiter plate according to this standard.

The carrier 2 therefore has two short narrow sides 16, 17 (transverse sides) and two long narrow sides 18, 19 (longitudinal sides).

On each of the short narrow sides 16, 17, the carrier 2 has a strip-shaped gripping tab 20 in the middle. The gripping tab 20 is located in front of a groove-like cut-out 21 which is formed in the outer side of the short narrow side 16, 17. The groove-like cut-out 21 extends in a vertical direction in the apron 11 through the skirting 12 and the top section 13 of the apron 11.

The gripping tab 20 is connected at the bottom in the area of the groove-like cut-out 21 to the bottom edge 22 of the apron 11. From its connection 23, it extends horizontally a short distance away from the apron 11. Subsequently, it runs vertically upward at a distance from the base of the cut-out 21. In this area, its outer side is flush with the outer side of the skirting 12. At the level of the top side of the skirting 12, the gripping tab 20 has a bend, and above the bend 24, the gripping tab 20 extends vertically upward beyond the cover wall 7. The top end of the gripping tab is for example arranged approximately at the level of the top end of the pipette tips 3 inserted in the carrier 2.

At the top edge of the bend 23, the gripping tab 20 has a locking bead 25 projecting outward in a horizontal direction. At the top end, the gripping tab has a gripping strip 26 that projects horizontally outward.

In each short narrow side 16, 17, vertically extending grooves 27, 28 are formed on both sides next to the gripping tab 20. On their outer edge, the grooves 27, 28 are each bordered by the outer edge of the groove-shaped cut-out 21. On their inner edge, they are each bordered by the gripping tab 20.

The grooves 27, 28 each have a groove width of 2.5 mm to 5 mm measured in the direction of the short narrow side 16, 17. In the example, it is 4 mm horizontally. Furthermore, the grooves 27, 28 have groove depths of 1.5 to 2.5 mm measured horizontally and vertically relative to the short narrow side 16, 17 in the area of the skirting 12. In the example, the groove depth is 2 mm.

The carrier 2 is made of plastic, preferably polypropylene (PP). Also preferably, the carrier 2 is manufactured by means of injection moulding. It is preferably injection moulded as a single part.

Figure 6:
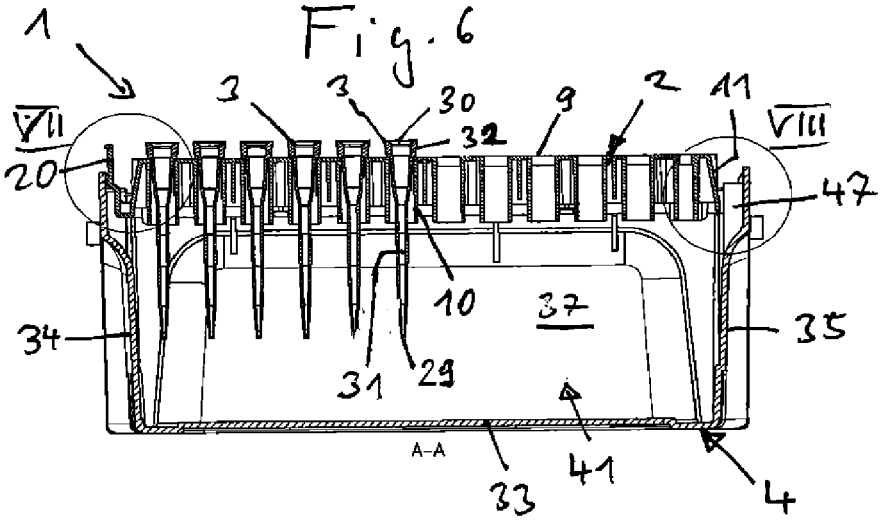
FIG. 6 the device in a section along line VI-VI from FIG. 2.
Figure 7:
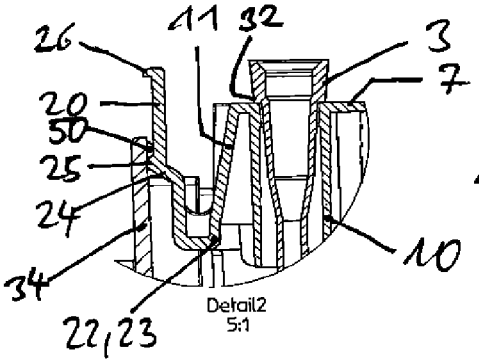
FIG. 7 Detail VII of the device according to FIG. 6.
Figure 8:
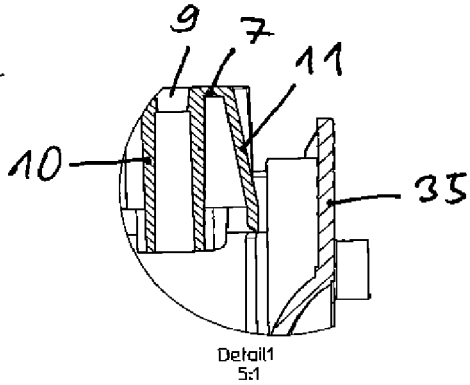
FIG. 8 Detail VIII of the device according to FIG. 6.
Figure 10:
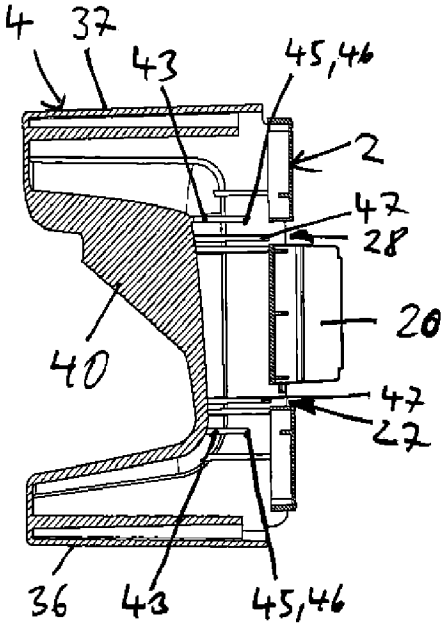
FIG. 10 the device in a section X-X from FIG. 9.

According to FIGS. 6 and 7, the pipette tips 3 are small tubes made of plastic that have a bottom opening 29 at the bottom for liquid and a top opening 30 at the top for air. The cross-section of the pipette tips 3 increases from the bottom toward the top opening. Between the bottom opening and the top opening, there is a capacity 31 for liquid in the pipette tips 3. At the top, the pipette tips 3 have a peripheral collar 32 projecting outward at the edge by means of which they abut the edge of the holes 9.

According to FIGS. 1 to 8, the bottom part 4 has a substantially rectangular floor wall 33, and first sidewalls 34, 35 and second sidewalls 36, 37 that extend upward from the side edges of the floor wall. The floor wall 33 has feet 38 with a standing surface 39 on the bottom side.

Each side wall 34 to 37 has an inward curvature 40 at a distance from its top and two vertical edges that extends to the floor wall 33. In the area of the curvatures 40, the side edges of the floor wall 33 are drawn in somewhat. The curvatures 40 reinforce the bottom part 4.

Figure 9:
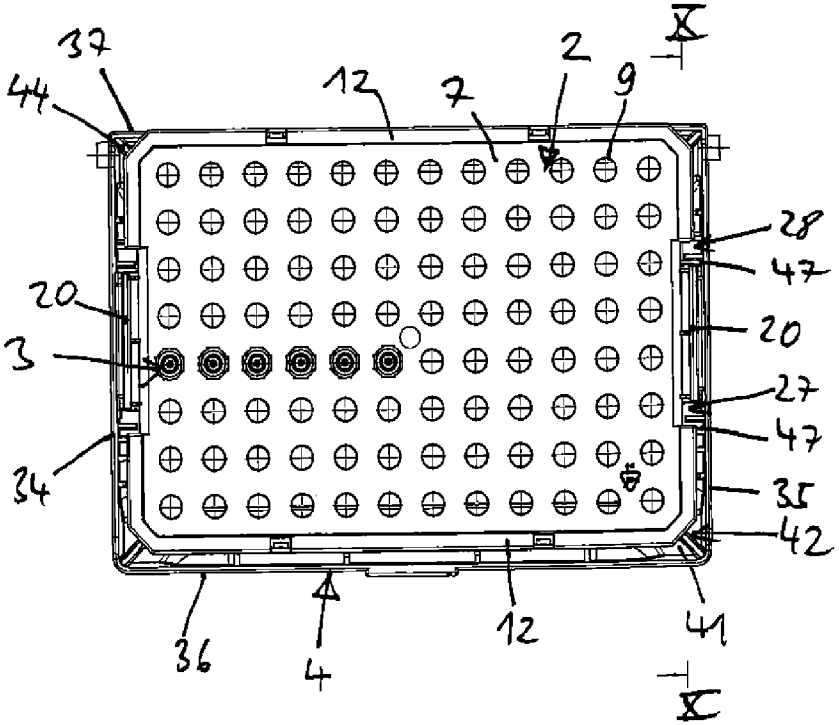
FIG. 9 a plan view of the device offset relative to the correct alignment of the carrier placed on the bottom part.
Figure 11:
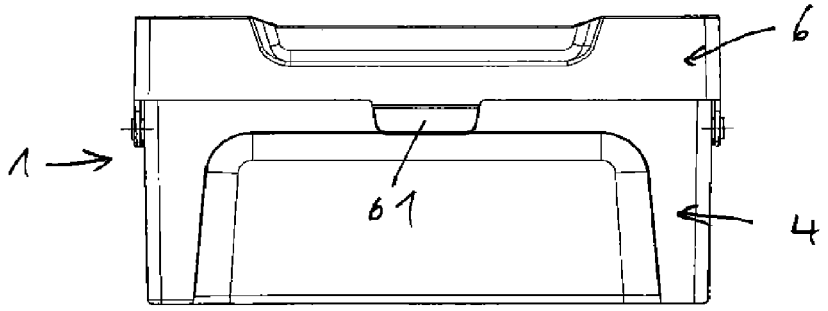
FIG. 11 a front view of the same device with a cover in closed position.
Figure 12:
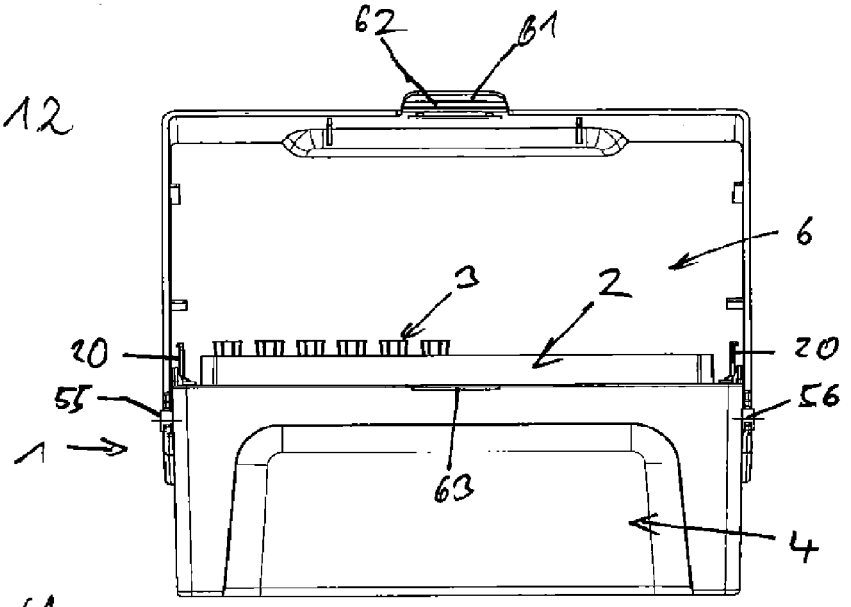
FIG. 12 a front view of the same device with an open cover.
Figure 13:
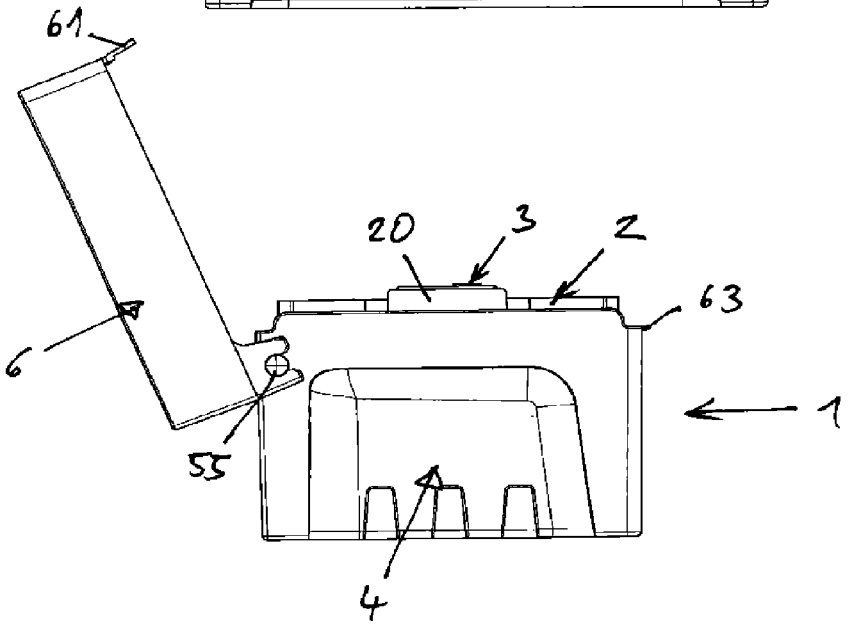
FIG. 13 the same device with an open cover in a view from the left side.

The side walls 34 to 37 border a seat 41 with a rectangular top opening 42 (see FIG. 9, 10). The seat 41 is dimensioned such that the carrier 2 equipped with pipette tips 3 is insertable from above through the top opening 42 into the seat 41. To this end, the dimensions of the top opening 42 exceed the base surface of the carrier 2 in both directions by a few milliliters.

The first sidewalls 34, 35 border the shorter edges of the top opening 42, and the second sidewalls 36, 37 border the longer edges of the top opening. The first sidewalls 34, 35 extend further upward from the floor wall 33 than the second sidewalls 36, 37.

Figure 5:
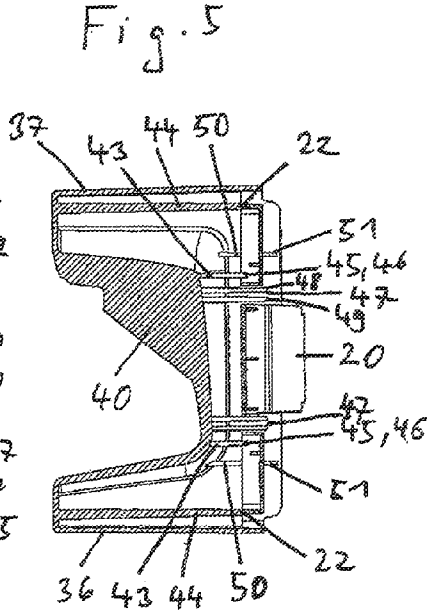
FIG. 5 the device in a section along line V-V from FIG. 2.
Figure 2:
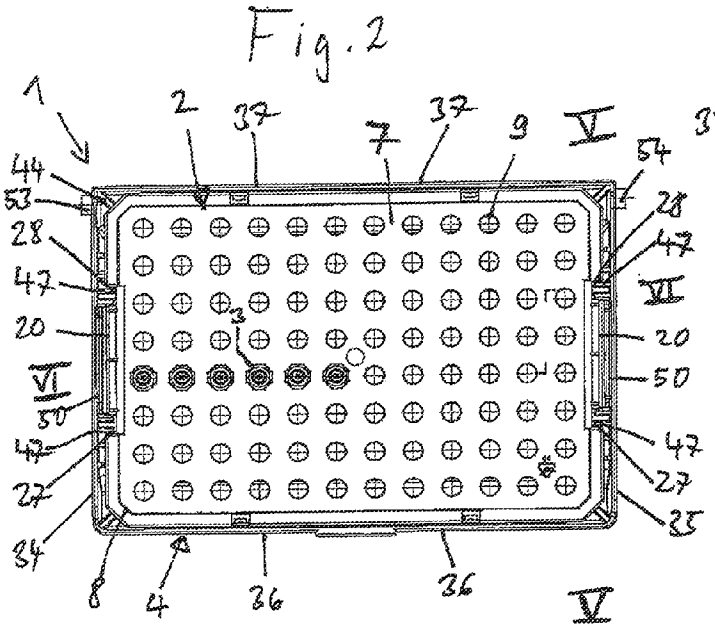
FIG. 2 the device in a plan view.
Figure 16:
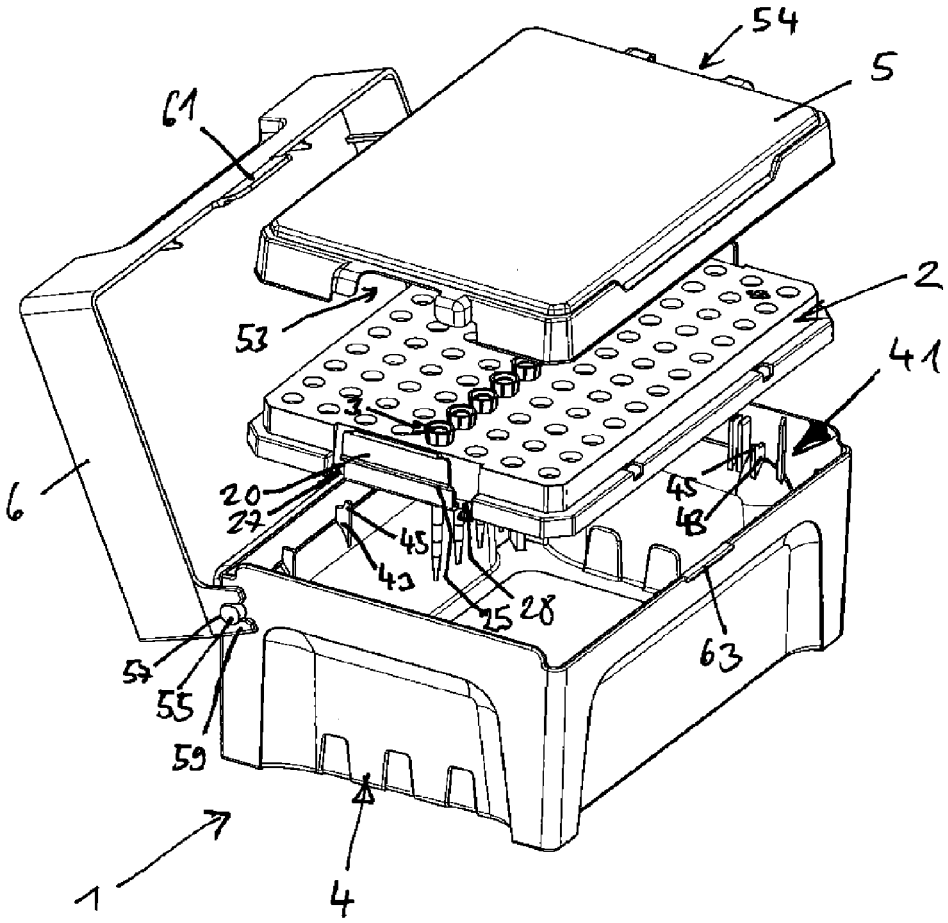
FIG. 16 the device with an open cover and protective cover in a perspective exploded view.
Figure 17A:
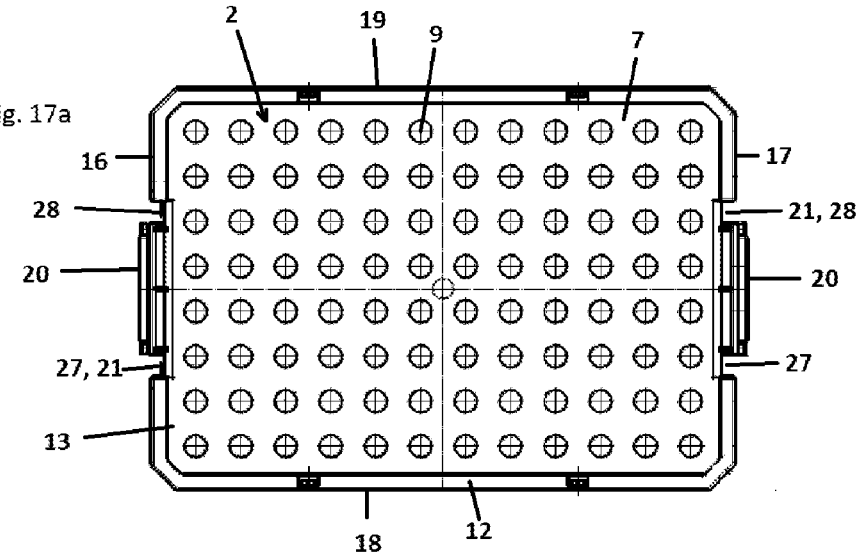
FIG. 17*a-d* another carrier in a plan view (FIG. 17*a*), a view from below (FIG. 17*b*), a side view (FIG. 17*c*) and in a section along the line d-d from FIG. 17*a* (FIG. 17*d*)
Figure 17B:
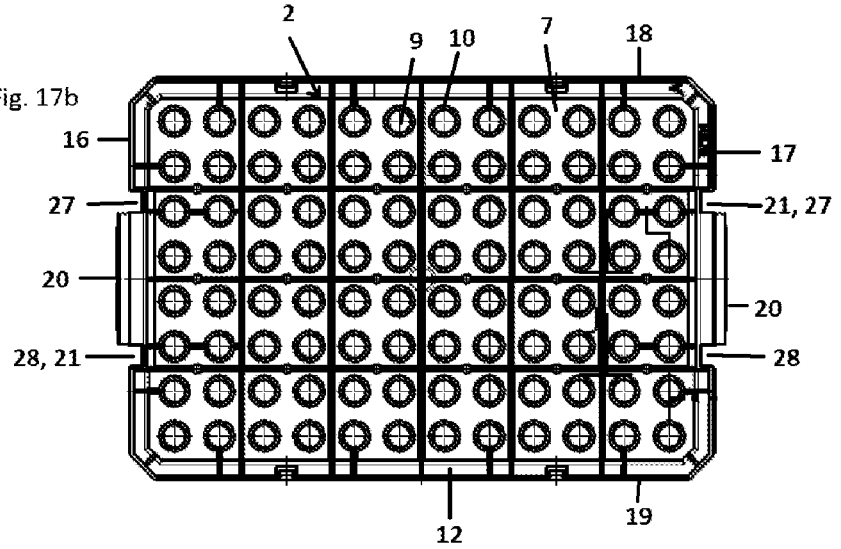
Figure 17C:
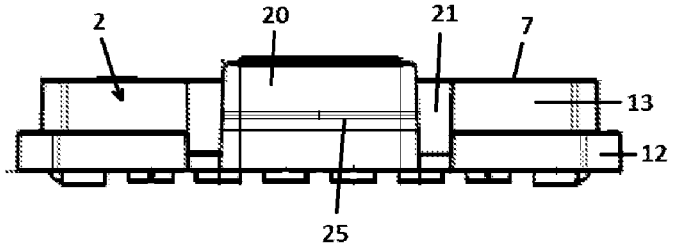
Figure 17D:
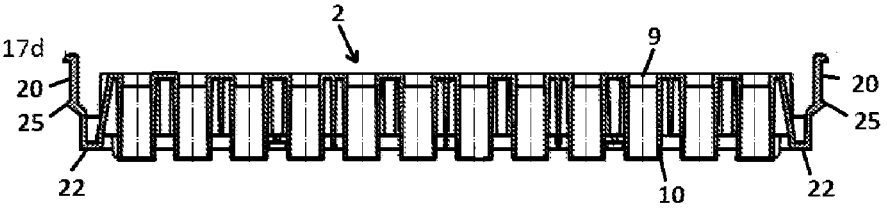
Figure 18A:
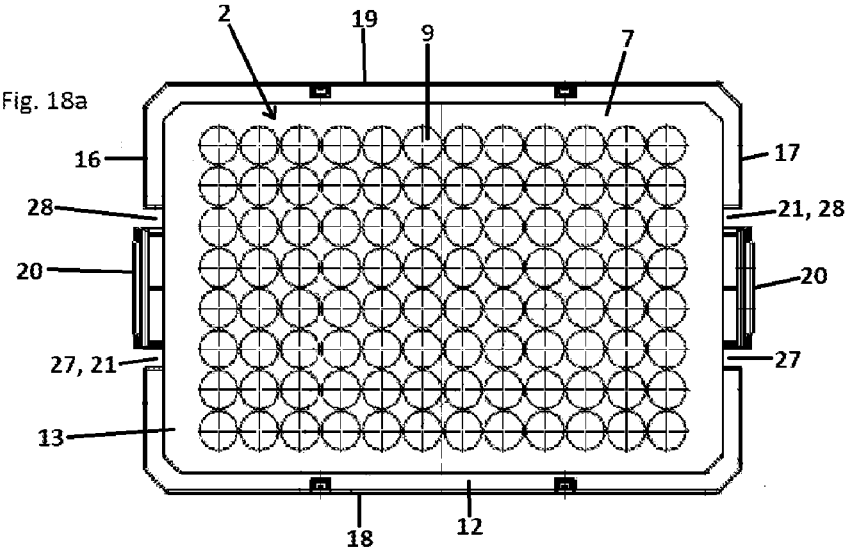
FIG. 18*a-d* another carrier in a plan view (FIG. 18*a*), a view from below (FIG. 18*b*), a side view (FIG. 18*c*) and in a section along the line d-d from FIG. 18*a* (FIG. 18*d*).
Figure 18B:
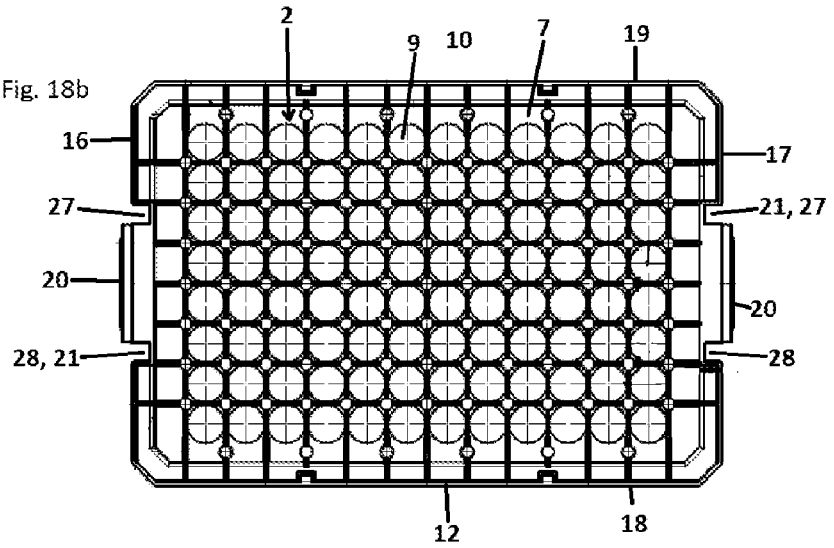
Figure 18C:
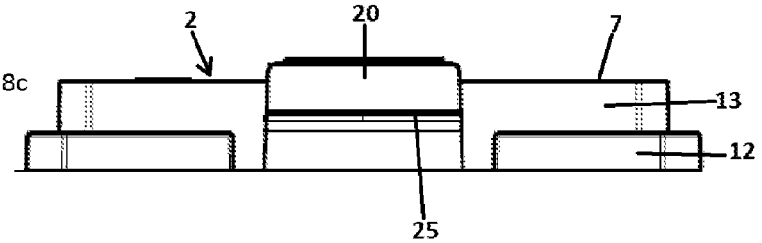
Figure 18D:
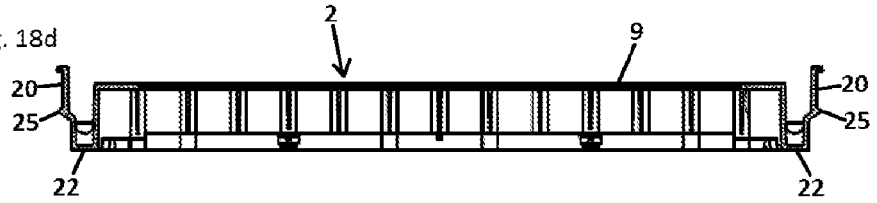

Means to support the carrier in the form of vertical ribs 43 project from the inner sides of the first and second sidewalls 34 to 37 (see FIGS. 5 and 16). Two ribs 43 are on the inner sides of the first sidewalls 34, 35. Four ribs 43 are on the inner sides of the second sidewalls 36, 37. These ribs 43 abut at the bottom the top edges of the curvatures 40.

In addition, a diagonal rib 44 is on each one of the edges between the first and second sidewalls 34 to 37 and is aligned at a 45° angle relative to the two neighbouring sidewalls 34 to 37. This diagonal rib 44 extends vertically downward to the floor wall 33.

The ribs 43, 44 project sufficiently far from the inner sides of the side walls 34 to 37 so that the bottom edge of the apron 11 of the carrier 2 can be placed on the ribs 43, 44.

On their inner edges at a distance from the first wall, the two ribs 43 on the inner side of each first sidewall 34, 35 have elevated projections 45 with bevels 46 on the outer sides that angle inward into the seat 41 (see FIG. 5). Furthermore, on their inner edges at a distance from the second sidewall 36, 37, the two middle ribs 43 on the inner side of each second sidewall 36, 37 have elevated projections 45 with bevels 46 on the outer sides that angle inward into the seat 41 (see FIG. 16). The projections 45 with the bevels 49 serve to grip behind the inner side of the apron 11 of the carrier 2 in the area of the skirting 12 in order to compensate for manufacturing-related concavities.

Furthermore, there are two vertical guide ribs 47 at a distance from each other on the inner sides of the first sidewalls 34, 35. The guide ribs 47 are supported at the bottom by the top edge of the curvature 40 of the first sidewall 34, 35 and extend vertically upward above the ribs 43, 44. At the top, the guide ribs 47 extend into the areas of the first sidewalls 34, 35 that project beyond the second sidewalls 36, 37. At that location, they terminate at the height of the top edge of the second sidewalls 36, 37.

Each guide rib 47 has a horizontal rib width of 2.5 mm to 4 mm measured in the direction of the first sidewall 34, 35. In the example, it is 3 mm.

Furthermore, each guide rib 47 has a rib height of 2.5 mm to 4 mm measured horizontally perpendicular to the first sidewall 34, 35. In the example, it is 3 mm.

Each guide rib 47 is formed from a group of two parallel rib elements 48, 49. Each rib element 48, 49 has a width of 0.5 to 1.5 mm. In the example, it is 1 mm. Furthermore, the distance between the rib elements 48, 49 of a group is 0.5 mm to 1.5 mm. In the example, it is 1 mm. Low-friction displacement of the carrier 2 to the correct alignment of the grooves 27, 28 on the guide ribs 47 is enabled by these dimensions of the guide ribs 47 and their formation from two rib elements 48, 49.

Furthermore, between the guide ribs 47 on the top edge, the first sidewalls 34, have rib-shaped locking projections 50 projecting from the inner side.

Finally, each first sidewall 34, 35 has vertically extending guide bars 51 projecting from the inner side outside of the ribs 43. At the bottom, the guide bars 51 abut the top edge of the curvature 40 of the first sidewalls 34, 35 and terminate at the top below the top edge of the first sidewalls 34, 35 in a lead-in chamfer 52. The guide bars 51 do not project as far from the inner sides of the first sidewalls 34, 35 as the ribs 43 and guide ribs 47. In the example, it is 0.5 mm.

The ribs 43 project inwardly 2 mm to 4 mm on the inner side of the first and second sidewalls 34 to 37. In the example, it is 3 mm. The diagonal ribs 44 project inwardly 4 mm to 8 mm. In the example, it is 6 mm.

The bottom part is made of plastic, preferably polypropylene (PP). Also preferably, the bottom part is manufactured by means of injection moulding. It is preferably injection moulded as a single part.

The carrier 2 equipped with pipette tips 3 is insertable through the top opening 42 of the bottom part 4 into the seat 41. The guide bars 51 make it easier to precisely align the carrier 2 between the first sidewalls 34, 35. When the carrier is not precisely aligned with the seat, the carrier 2 rests with the bottom edges 22 of the skirting 12 and the gripping tabs 20 on the top ends of the guide ribs 47 (see FIG. 9, 10). The carrier is displaceable in a horizontal direction parallel to the first sidewalls 34, 35 until the guide ribs 47 are precisely aligned with the grooves 27, 28 in the short narrow sides 16, 17 of the carrier 2. Then the two long narrow sides 18, 19 of the carrier 2 are located within the two sidewalls 35, 36. The carrier 2 moves downward somewhat from its own weight. By swinging the gripping tabs 20 together and lowering the carrier 2 further, said carrier is pressed against the ribs 43, 44 with the bottom edge 22 of the skirting 12. The projections 45 then grip behind the inner sides of the skirting 12. By releasing the gripping tabs 20, the locking beads 25 and locking projections 50 lock with each other. The carrier 2 is then releasably attached to the bottom part 4 (see FIGS. 1 to 8). Then the pipette tips 3 can be removed individually by means of a single channel pipette or in groups by means of a multichannel pipette.

After all pipette tips 3 have been used, the carrier 2 can be unlocked by swinging together the gripping tabs 20 and pulled out of the bottom part 4 by the gripping tabs 20. Then a carrier 2 equipped with fresh pipette tips 3 can be inserted in the bottom part 4 in the described manner.

When the carrier 2 is locked in the bottom part 4, the top section 13 of the long narrow sides 16, 17 arranged above the skirting 12 is visible on the outside. Product information can be affixed to this section 13 which can be easily perceived by the user. This is for example information about the filling volume and type of pipette tips.

Additional information can be affixed to the outer sides of the skirting 12 which is required less frequently (such as the order number, expiration date or lot number).

Figure 14:
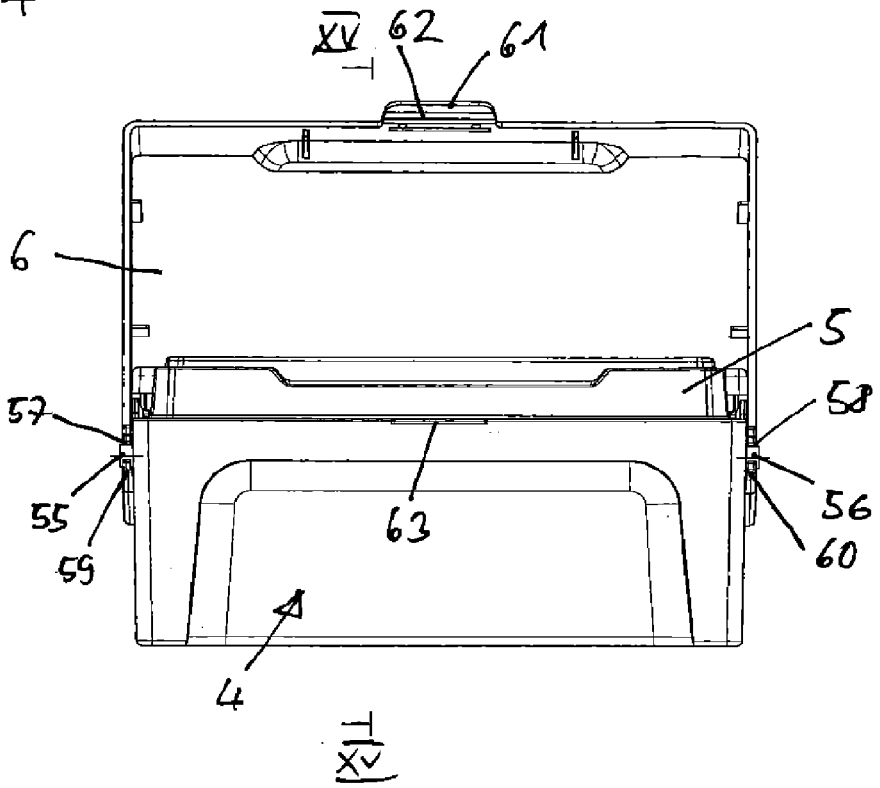
FIG. 14 a front view of the same device with an open cover and mounted protective cover.
Figure 15:
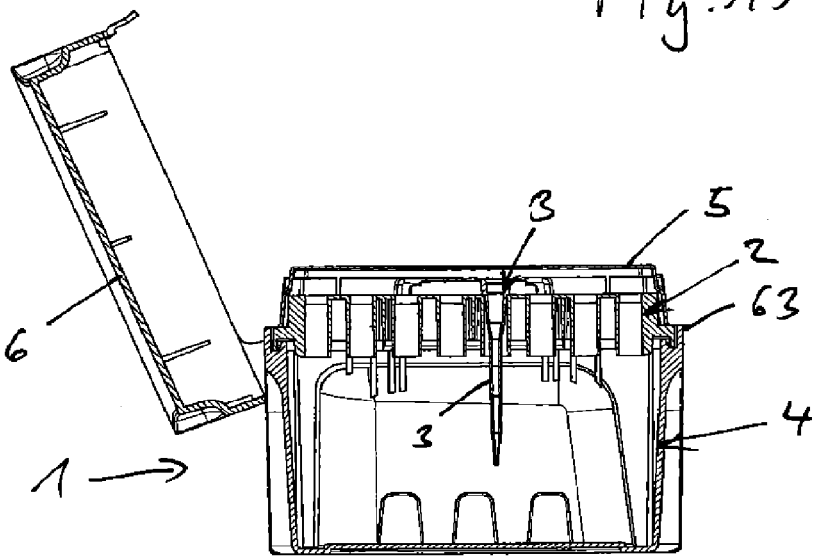
FIG. 15 the device with an open cover and a mounted protective cover in a section along line XV-XV from FIG. 14.

According to FIGS. 14 to 16, a protective cover 5 covers the pipette tips 3, and its bottom edge abuts the top side of the skirting 12. On the gripping tabs 20, the protective cover 5 has opening areas 53, 54 through which the gripping tabs 20 are actuatable.

The carrier 2 equipped with pipette tips 3 and covered by the protective cover can be inserted in the bottom part 4. The pipette tips 3 are thereby protected by the protective cover 5.

Slightly below their top edge at a short distance from the first sidewall, the first sidewalls 34, 35 have two pins 55, 56 that project outward horizontally (see FIGS. 11 to 16). A hood-like cover 6 is mounted on the pins 55, 56 on bearing eyes 57, 58 in strip-shaped bearing sections 59, 60. On the bottom edge of its opposite longitudinal side, the cover 6 has a locking tab 61. The locking tab 61 has a third locking bead 62 on its inner side that interacts with an outwardly projecting fourth locking bead 63 on the top edge of the second sidewall 36.

In a swung-to closed position, the cover 6 covers the carrier 2 with the inserted pipette tips 3 and is locked to the bottom part 4. In open position, the cover 6 is folded out by more than 90°, and the bottom edge of its longitudinal side abuts the outer side of the second side wall 37 next to the bearing sections 59, 60. In this position, the carrier 2 can be inserted and removed, and pipette tips 3 can be removed from the inserted carrier 2.

FIGS. 17 and 18 show another carrier 2 for pipette tips that can be used together with the bottom part 4 and protective cover 5 as well as the cover 6. In contrast to the carrier 2 depicted in FIGS. 1 to 16, the groove-like cut-outs 21 are exclusively in the skirting 12 in the carrier 2 in FIG. 17. The base of the groove-like cut-outs 21 is flush with the outer side of the top section 13 of the apron 11.

With this carrier 2 as well, the gripping tab 20 is connected at the bottom in the area of the groove-like cut-out 21 to the bottom edge 22 of the apron 11 and runs upward at a distance from the base of the cut-out 21. In each short narrow side 16, 17, vertically extending grooves 27, 28 are formed on both sides next to the gripping tab 20 in the skirting 12. On their outer edge, the grooves 27, 28 are each bordered by the outer edge of the groove-shaped cut-out 21 in the skirting 12. On their inner edge, they are each bordered by the gripping tab 20.

Like the above-describe carrier, the carrier 2 in FIG. 18 has cut-outs 21 and grooves 27, 28 that extend exclusively through the skirting 12. With this carrier 12 as well, the base of the cut-out 21 is flush with the top section 13 of the apron 11.

The carrier 2 according to FIG. 17 has smaller holes 9 for pipette tips than the carrier 2 in FIG. 18. For example, the carrier 2 in FIG. 17 is for pipette tips with a capacity of 10 μl, and the carrier 2 in FIG. 18 is for pipette tips with a capacity of 1000 μl.

The carriers 2 equipped with pipette tips in FIGS. 17 and 18 are insertable in the seat 41 of the bottom part 47 until the guide ribs 4 engage in the grooves 27, 28 in the narrow sides 16, 17, and the locking beads 25 of the gripping tabs 20 lock behind the locking projections 50. These carriers 2 can also be unlocked by means of gripping tabs 20 that fold together, and can be pulled out of the bottom part 4 by the gripping tabs 20.

This completes the description of the preferred and alternate embodiments of the invention. Those skilled in the art may recognize other equivalents to the specific embodiment described herein which equivalents are intended to be encompassed by the claims attached hereto.

LIST OF REFERENCE NUMBERS

1 Device
2 Carrier
3 Pipette tips
4 Bottom part
5 Protective cover
6 Cover
7 Cover wall
8 Chamfer
9 Hole
10 Sleeve
11 Apron
12 Skirting
13 Top section
14, 15 Chamfer
16, 17 Short narrow side (short transverse side)
18, 19 Long narrow side (long longitudinal side)
20 Gripping tab
21 Cut-out
22 Bottom edge
23 Connection
24 Bend
25 Locking bead
26 Gripping strip
27, 28 Groove
29 (Bottom) opening
30 (Top) opening
31 Capacity
32 Collar
33 Floor wall
34, 35 (First) sidewall
36, 37 (Second) sidewall
38 Foot
39 Standing surface
40 Curvature
41 Seat
42 Top opening
43 Rib
44 Diagonal rib
45 Projection
46 Bevel
47 Guide rib
48, 49 Rib element
50 Locking projection
51 Guide bar
52 Lead-in chamfer
53, 54 Opening area
55, 56 Pin
57, 58 Bearing eye
59, 60 Bearing section
61 Locking tab
62 Third locking bead
63 Fourth locking bead

What is claimed is:

1. A device for providing pipette tips comprising:

a plate-shaped carrier (2) with a substantially rectangular base surface, a plurality of holes (9) in the carrier (2) aligned perpendicular to the base surface, at least one vertically running cut-out (21) in the outer sides of two opposing narrow sides (16, 17) of the carrier (2) that are dimensioned to each at least partially accommodate two vertical guide ribs (47) at a distance from each other, each having a rib width of 2.5 mm to 4 mm and a rib height of 2.5 mm to 4 mm, pipette tips (3) inserted in the holes (9), a bottom part (4) with sidewalls (34 to 37) that extend upwards from a standing surface (39), said sidewalls surrounding a rectangular seat (41) for the carrier (2) with the inserted pipette tips (3), wherein two opposing first sidewalls (34, 35) project further upward from the standing surface (39) than to opposing second sidewalls (35, 36), a supporting mechanism (43, 44) on the inner sides of at least two opposing sidewalls that are constituted such that they support the carrier (2) in a horizontal alignment at the bottom edges (22) of narrow sides (16, 17) below the top edges of all sidewalls (34 to 37), the arrangement of the supporting mechanism (43, 44) and of the guide ribs (47) is such that the engagement of the carrier (2) with the support mechanism takes place only when the guide ribs are introduced into at least one cutout (21) the at least one cut-out (21) in at least one narrow side of the carrier having two vertical grooves (27,28) disposed at a distance from each other, and the carrier rests on the top of the guide ribs (47) when the guide ribs (47) are in misalignment to the at least one cutout (21), and wherein the two vertical guide ribs (47) at a distance from each other, engage in the at least one cut-out (21) in a narrow side (16, 17) of the carrier (2) when the carrier (2) is placed on the supporting mechanism (43, 44).

2. The device according to claim 1, wherein each guide rib (47) is formed from a group with at least two parallel rib elements (48, 49), wherein each rib element has a width of 0.50 mm to 1.5 mm, and the distance between the rib elements (48, 49) of a group is 0.5 mm to 1.5 mm.

3. The device according to claim 1, wherein the dimensions of a carrier (2) in the direction parallel to the second sidewalls (36, 37) at the bottom edge (22) of the carrier (2) is less than the distance of 4 mm to 7 mm between the first sidewalls (34, 35) at the top edge of the first sidewalls (34, 35).

4. The device according to claim 1, wherein the two vertical grooves (27, 28) each have a groove width of 2.5 mm to 4.5 mm.

5. The device according to claim 1, wherein the outer edge of the at least one cut-out (21) in at least one narrow side (16, 17) of the carrier (2) is bordered by an outwardly projecting skirting (12) that runs along the bottom edge of the carrier (2).

6. The device according to claim 5, wherein the outer edge of the at least one cut-out (21) in at least one narrow side (16, 17) of the carrier (2) is bordered only by an outwardly projecting skirting (12) that runs along the bottom edge of the carrier (2).

7. The device according to claim 1, wherein the inner edge of the at least one cut-out (21) is bordered in at least one narrow side (16, 17) by a gripping tab (20) which is connected at the bottom to the bottom edge of the narrow side (16, 17) of the carrier (2) and extends upward beyond the first sidewalls (34, 35) at a distance from the narrow side (16, 17).

8. The device according to claim 7, wherein the at least one gripping tab (20) has a first locking mechanism (25) on its outer side above its connection (23) to the carrier (2), said first locking mechanism locking with second locking mechanism (50) on the inner side of the neighbouring first sidewall (34, 35).

9. The device according to claim 8, wherein the gripping tabs (20) are strip-shaped and have a first mechanism for locking (25) in the form of at least one outwardly projecting horizontal locking bead (25).

10. The device according to claim 1, wherein the carrier (2) has a horizontal cover wall (7) with holes (9) arranged therein, and a peripheral apron (11) projecting downward from the side edges of the cover wall (7).

11. The device according to claim 10, wherein the apron (11) has an outwardly projecting bottom section forming the skirting (12) outside of the cut-out (21).

12. The device according to claim 10, wherein the edges of the holes (9) are connected to sleeves (10) that project from the bottom side of the cover wall (7) and into which the pipette tips (3) are inserted.

13. The device according to claim 1, wherein the supporting mechanism (43, 44) comprises vertical ribs projecting from the inner sides of the side walls.

14. The device according to claim 1, wherein the supporting mechanism (43, 44) has projections (45) that project at least partially from their inner edges with bevels (46) on the outer sides angled into the interior of the seat (41) that grip behind the inside of the apron (11) of the carrier (2).

15. The device according to claim 1, wherein a protective cover (5) is placed on the top side of the carrier (2) and covers the pipette tips (3) inserted in the holes (9).

16. The device according to claim 1, wherein the bottom part (4) has a pivotably mounted cover (6) that, when in closed position, covers the seat along with an inserted carrier (2) and if applicable a protective cover (5) mounted thereupon, and is pivotable into an open position in which the carrier (2) with the pipette tips (3) and if applicable the mounted protective cover (5) are removable from the bottom part (4), and insertable therein, and the pipette tips (3) are removable from the carrier (2).

17. The device according to claim 1, wherein the carrier (2), and/or the bottom part (4), and/or the protective cover (5), and/or the cover (6) is manufactured from at least one plastic.

* * * * *